United States Patent [19]

Nourry

[11] Patent Number: 4,677,261

[45] Date of Patent: Jun. 30, 1987

[54] DEVICE FOR LOCKING THE CONTROL MEMBER OF AN ELECTRICAL APPLIANCE OF THE MANUAL CONTROL TYPE

[75] Inventor: Daniel Nourry, Dijon, France

[73] Assignee: La Telemecanique Electrique, Nanterre, France

[21] Appl. No.: 765,117

[22] Filed: Aug. 13, 1985

[30] Foreign Application Priority Data

Aug. 16, 1984 [FR] France ..... 84 12845

[51] Int. Cl.[4] ..... H01H 9/28

[52] U.S. Cl. ..... 200/43.15; 200/43.01

[58] Field of Search ..... 200/43.01, 43.11–43.19, 200/43.21, 43.22; 70/DIG. 30, 166, 164, 174, 180

[56] References Cited

U.S. PATENT DOCUMENTS

| | | | |
|---|---|---|---|
| 1,894,660 | 1/1933 | Black et al. | 70/180 |
| 2,192,060 | 2/1940 | Wise | 200/43.15 |
| 2,662,389 | 12/1953 | McKitrick | 70/174 |
| 2,983,799 | 5/1961 | Osieja et al. | 200/43.15 |
| 3,214,530 | 10/1965 | Tharp et al. | 200/43.15 |
| 3,291,924 | 12/1966 | Tharp | 200/43.15 |
| 4,260,861 | 4/1981 | DiMarco | 200/43.15 |
| 4,300,030 | 11/1981 | Dimarco et al. | 200/43.19 |

FOREIGN PATENT DOCUMENTS 4212154 7/1979 France .

*Primary Examiner*—Stephen Marcos
*Assistant Examiner*—Ernest G. Cusick
*Attorney, Agent, or Firm*—Young & Thompson

[57] ABSTRACT

The device for locking the manual control lever (14) of an electrical appliance such as a switch comprises two adjacent portions (1) pivotally joined together by means of a hinge portion (2), fastening means (3) each extending along an edge portion located in spaced relation to the hinge portion (2), at least one bearing surface (4) provided on one of the adjacent portions (1) and at least one locking orifice (5) formed in each adjacent portion and so arranged as to come into position in register with the corresponding locking orifice (5) of the other adjacent portion (1) when the device is in the locking position. The device can then be maintained in the locking position by the shackle of a padlock engaged in one of the orifices (5) or by a lead-sealed wire.

12 Claims, 6 Drawing Figures

DEVICE FOR LOCKING THE CONTROL MEMBER OF AN ELECTRICAL APPLIANCE OF THE MANUAL CONTROL TYPE

BACKGROUND OF THE INVENTION

1. Field of the Invention

The present invention relates to a device for locking the control member of an electrical appliance of the manual control type.

2. Description of the Prior Art

It is known that, in the case of certain types of electrical appliances which are designed for manual control, especially switches placed in the power supply system of a distribution network, it may be desirable to maintain the control member in a predetermined position, in particular for safety reasons.

Devices for locking the manual control member of an electrical appliance are already known. However, these devices do not usually permit easy and effective positioning of a padlock or of a lead seal. Some types of locking device can in fact be fitted with a padlock but their structure is such that effective locking cannot be obtained simply by means of a lead seal. Other types of locking device can on the contrary be provided with an effective seal but are not designed for the purpose of fitting padlocks.

SUMMARY OF THE INVENTION

One aim of the present invention is to provide a device for locking the control member of an electrical appliance of the manual control type which has a simple structure and permits effective locking both by means of a padlock and by means of a simple lead-sealed wire.

In order to achieve this objective, there is provided in accordance with the invention a device for locking the control member of an electrical appliance of the manual control type, said device being essentially constituted by two adjacent portions pivotally joined together by means of a hinge portion, fastening means each extending along an edge portion located in spaced relation to said hinge portion, at least one bearing surface provided on one of the adjacent portions aforesaid and at least one locking orifice formed in each adjacent portion and so arranged as to come into position in register with the corresponding locking orifice of the other adjacent portion when the device is in the locking position.

Thus, while the device is being placed in position, the two adjacent portions are inclined with respect to each other about the hinge portion and the bearing surface is located at a distance from the manual control member which can be operated if so required. On the contrary, when the locking device has been placed in position with the locking orifices in register, the bearing surface prevents operation of the manual control member. The locking device can be maintained in the locking position either by the shackle of a padlock which extends through the orifices or by a wire passed through the orifices and tightly secured against the edge of the locking device by means of a lead seal.

In an advantageous embodiment of the invention, the hinge portion between the adjacent portions projects with respect to the bearing surfaces when the device is in the locking position. Thus the locking device is applied against the manual control member with greater force.

In a preferred embodiment of the locking device in accordance with the invention, the locking orifices are formed in wings, each wing being hinged with one of the adjacent portions.

Thus the locking device can be manufactured in the flat state and the locking orifices are placed in oppositely-facing relation by rotating the wings about their respective articulation means or hinge elements.

In accordance with another distinctive feature of the preferred embodiment of the invention, at least one of the wings has a positioning stud which extends transversely to the plane of the wing and the other wing has a corresponding hole for receiving the positioning stud when the device is in the locking position. Thus, by causing the positioning stud of one wing to penetrate into the corresponding hole of the other wing, positioning of the locking device is ensured prior to positioning of the retaining means such as the padlock or the lead-sealed wire.

According to another aspect of the invention, the locking orifices are closed-off by means of a partition wall which is brittle in a direction transverse to its plane and resistant in a direction substantially parallel to its plane, said partition wall being preferably provided with weakening grooves. It is thus possible to cut-out the partition wall so as to form an orifice which corresponds exactly to the cross-section of the retaining means.

BRIEF DESCRIPTION OF THE DRAWINGS

Other features of the invention will be more apparent upon consideration of the following description and accompanying drawings, wherein.

DESCRIPTION OF THE PREFERRED EMBODIMENTS

Figure 1:
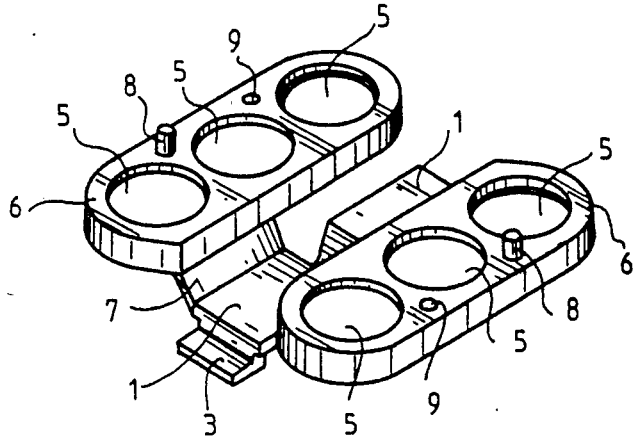
FIG. 1 is a top view in perspective showing the locking device in the open position.
Figure 2:
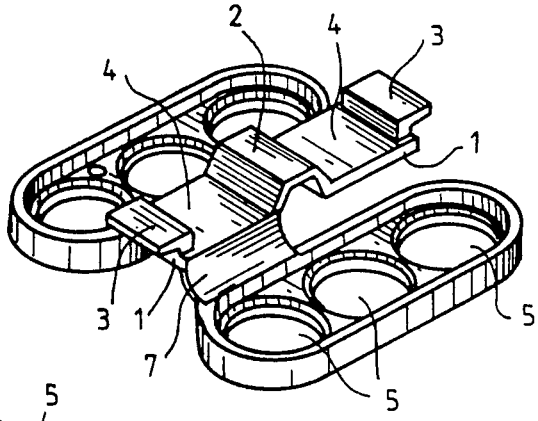
FIG. 2 is a bottom view in perspective showing the locking device in the open position.
Figure 3:
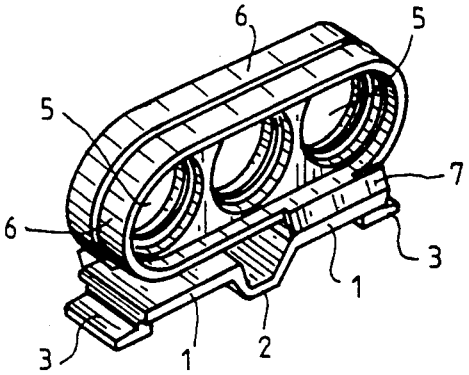
FIG. 3 is a perspective view of the device in the closed position.

As shown in the figures, the locking device in accordance with the invention comprises two bearing portions or base portions 1 pivotally joined together by means of a hinge portion 2. Fastening means formed in this example by lugs 3 which form projections with respect to the ends of the bearing portions 1 each extend along an edge portion located in spaced relation to the hinge portion 2. In the embodiment shown in the drawings, each bearing portion 1 has a bearing surface 4 and is associated with orifice means comprised of three locking orifices 5 which are intended to come into position opposite to and in register with the corresponding locking orifices of the other bearing portion when the device is in a locking position (as shown in FIGS. 5 and 6).

Figure 6:
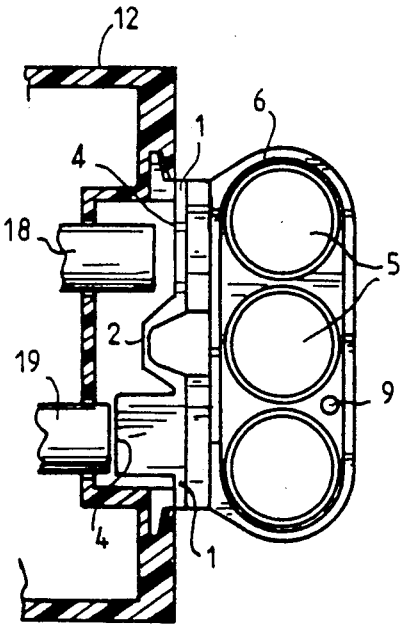
FIG. 6 is a diagrammatic sectional view of an alternative embodiment of the locking device in position on an electrical appliance provided with a push-button control.
Figure 5:
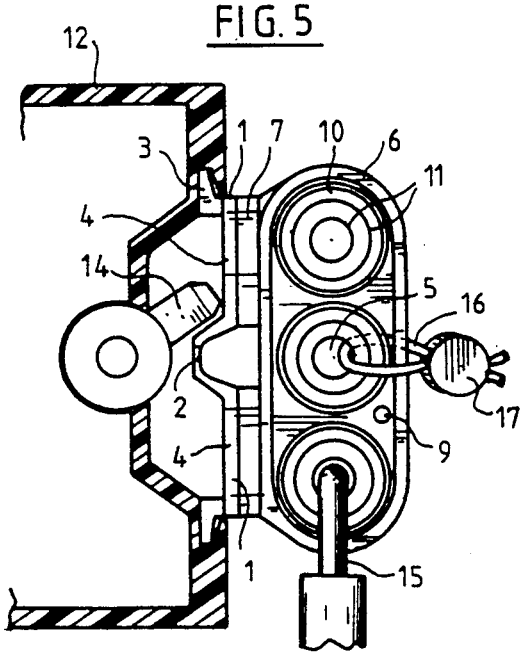
FIG. 5 is a diagrammatic sectional view of a manual-control appliance with the locking device in the closed position.

The hinge portion 2 formed by a thin wall in the form of a bridge between the bearing portions 1 projects with respect to the bearing surfaces 4 (as shown in FIGS. 5 and 6).

The locking orifices 5 are formed in wings 6, each wing being pivotally joined to one of the adjacent bearing portions 1 by means of a hinge element 7.

In the embodiment illustrated in the drawings, each wing 6 is provided with a positioning stud 8 which extends transversely to the plane of the wing 6 and with a hole 9 which corresponds to the positioning stud 8 in the other wing for receiving said positioning stud when the device is in the locking position. The studs 8 and holes 9 are thus complementary means for mutual positioning of the wings.

FIG. 5 illustrates an alternative embodiment of the device in which the orifice means 5 are closed-off by means of a thin partition wall 10 in which are formed weakening grooves 11, with the result that the thin partition wall 10 is brittle in a direction transverse to its plane and is relatively resistant in a direction substantially parallel to its plane.

By way of example, the locking device in accordance with the invention has been made of plastic material and more particularly polypropylene which has a sufficient degree of strength and rigidity to ensure that the bearing portions 1 in the form of plates and the wings 6 are rigid while having at the same time a sufficient degree of flexibility to ensure that a thin wall made of this material has the requisite flexibility to form the hinge portions 2 and 7. It has thus been possible to mold the device in one piece. Said device can therefore be produced rapidly at low cost.

Figure 4:
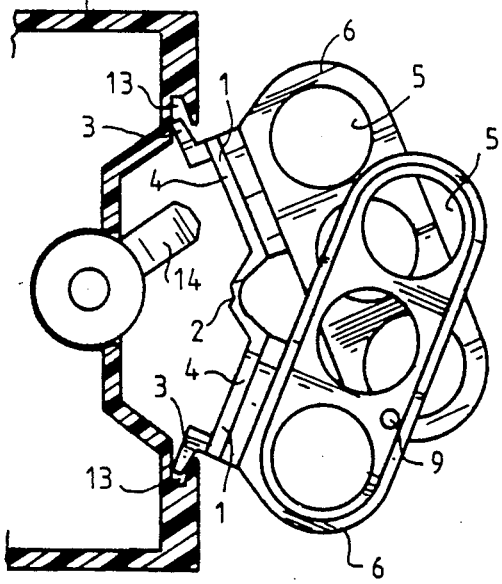
FIG. 4 is a diagrammatic sectional view of a manual-control appliance at the moment of positioning of the locking device.

FIGS. 4 and 5 illustrate the positioning of the locking device in accordance with the invention on a switch provided with a casing 12 having recesses 13, the shape of which is substantially complementary to that of the lugs 3 of the device. The lugs 3 and recesses 13 are engagement means for mutaul engagement of each base portion with the housing. The switch is provided in addition with a pivoted manual control lever 14, a recess 13 being located on each side of said lever.

For the purpose of positioning the device, the two bearing portions 1 are inclined with respect to each other about the hinge portion 2. The wings 6 are located in any position and may, for example, be folded back substantially at right angles to the bearing portions 1 as shown in FIG. 4. The lugs 3 are then introduced into the recesses 13, whereupon the bearing portions 1 are thrust back by hand while maintaining the wings 6 in substantially parallel relation until the moment when the locking orifices 5 of each wing 6 are in register. The control lever 14 of the switch is thus located opposite to a bearing surface 4 and, in the case shown in FIG. 5, on one side of the hinge portion 2 which projects with respect to the surface 4. The wings 6 are then applied against each other and the stud 8 of one wing penetrates into the corresponding hole 9 of the other wing, with the result that the device is temporarily maintained in the locking position. The device is then maintained more securely in the locked position either by introducing one or a number of locking members being padlock shackles 15 having a diameter in the vicinity of the orifice 5 which has been formed in the wing 6 or by means of a locking member being a wire 16 which is tightly secured within one orifice 5 by means of a lead seal 17. It is observed in practice that, by reason of the small clearance which exists between the orifice 5 and the padlock shackle 15 or between the loop of the wire 16 and the rims of the wings 6, the bearing portions 1 are capable of pivotal displacement about the hinge portion 2 only to a negligible extent and any attempt to operate the control lever 14 has the effect of bringing this latter into contact with the bearing surface 4 and the side of the hinge portion 2 without any possibility of pivotal displacement of the control lever 14 over its full range of travel. Furthermore, by locking the hinge portion 2 between the adjacent portions 1, the locking means prevent the device from being forcibly removed since the lugs 3 cannot be disengaged from the recesses 13.

In the alternative embodiment of FIG. 6, the locking device in accordance with the invention is more particularly adapted to a switch comprising two pushbuttons 18, 19 which are depressed or withdrawn in alternate sequence. As in the preceding embodiment, the device comprises two bearing portions 1 which are pivotally displaceable about a hinge 2 and are adapted to support wings 6 in which are formed orifices 5. In this embodiment, one of the bearing surfaces 4 projects with respect to the plane of the other bearing surface 4 and, at the time of positioning of the device, is placed opposite to the pushbutton 19 which is in the depressed position. Thus, aside from the fact that the upper bearing portion 1 masks the push-button 18, this push-button cannot be operated since it would cause outward displacement of the push-button 19 which would then come into abutting contact with the corresponding bearing surface 4.

As will readily be apparent, the invention is not limited to the embodiments described in the foregoing and alternative forms of construction may accordingly be contemplated.

By way of example, the bearing portion 1 is not necessarily made of plastic but can be formed of rigid material such as steel or a light alloy, in which case the hinge 2 is formed by a pin engaged within sleeves rigidly fixed to the bearing portions 1. The openings 5 can also be formed in wings 6 which are rigidly connected to the portions 1 in a transverse direction with respect to these latter.

Although the device in accordance with the invention has been shown with three orifices 5 which permit the introduction of three different padlocks in accordance with prevailing safety standards, provision can be made for only one orifice associated with each bearing portion 1 or on the contrary for a greater number of orifices.

It is readily apparent that the profile of the bearing surfaces 4 can be adapted to the shape of the manual control member of the electrical appliance on which the locking device is mounted.

Moreover, although the hinge portion 2 is shown in the drawings in a central position of the device for reasons of symmetry of movement of the manual control lever 14, it would be possible to place the hinge portion 2 in an off-center position or to replace this latter by any equivalent means permitting displacement of the bearing surfaces 4 in order to move them away from the manual control lever when the orifices 5 are not maintained in register and on the contrary to maintain these latter in proximity to the manual control lever when the orifices 5 are placed in register and maintained in this position.

What is claimed is:

1. A device for locking a control member (14, 19) of a manually controllable electrical appliance, wherein said device comprises a base having two base portions hinged together about a first axis by means of a hinge portion (2), each base portion having an engagement means (3) adapted for engaging a casing (12) of an electrical appliance, the two engagement means (3) being provided at a distance from each other on either side of the hinge portion (2), two wings (6) each of which is hinged to a respective one of the base portions about a respective one of two second axes, said second axes extending transversely to the first axis and being disposed adjacent opposite edges of the base, orifice means in each wing for allowing introduction of a locking member (15, 16) whereby the wings (6) are movable with respect to each other between a mutually spaced apart position and a service position in which service position said wings lie adjacent to each other, wherein in a locking position of said base portions with respect to each other about said first axis, the orifice means of both wings (6) are mutually registering, and wherein the base portions, the hinge portion and the wings are made of a common single piece of molded plastic material.

2. A device according to claim 1, wherein the orifice means (5) are closed off by means of partition walls (10) which are brittle in a direction transverse to their planes and mechanically resistant in a direction substantially parallel to their planes.

3. A device according to claim 2, wherein the partition walls (10) have weakening grooves (11) therein.

4. A device according to claim 1, wherein the wings are provided with complementary means for mutual positioning of the wings, said complementary means being in releasable mutual engagement when the base portions are in their locking position and the wings are in their service position.

5. A device according to claim 1, and designed for use with an electrical appliance provided with a manual control unit comprising two push-buttons (18, 19), wherein, from the base portions, the wings in the service position are pointing in a first direction, and the base portions have mutually offset faces facing in a direction pointing away from the wings in the service position.

6. A device according to claim 1, wherein from the base portions, the wings in the service position are pointing in a first direction, and the hinge portion (2) is offset with respect to the base portions in a direction opposite to the first direction.

7. Appliance comprising a control member (14, 18, 19) projecting from a housing (12) and movable between at least two positions, and a device for locking the control member, the device comprising a base having two base portions hinged together about a first axis by means of a hinge portion, each base portion and the housing having engagement means (3, 13) for mutual engagement of each base portion with the housing, said engagement means being provided on each base portion at a distance from the hinge portion (2), two wings (6) integral with the base portions and the hinge portion of plastic material, each said wing being hinged to a respective one of the base portions about a respective one of two second axes, said second axes extending transversely to the first axis and being disposed adjacent opposite edges of the base, orifice means (5) in each wing for allowing introduction of a clocking member (15, 16), wherein by mutual movement about the first axis, the base portions are able to move from a released position toward a locked position in which there is mutal engagement of the engagement means (3, 13) so as to retain the device on the appliance, and wherein each wing (6) is movable about its respective second axis between a mutually spaced apart position and a service position in which on the one hand said wings lie adjacent to each other and, on the other hand, when the base portions are in the locked position, the orifice means of both wings mutually register while the base locks the control member in one of its two positions.

8. An appliance according to claim 7, wherein the orifice means (15) are closed off by means of partition walls (10) which are brittle in a direction transverse to their planes and mechanically resistant in a direction substantially parallel to their planes.

9. An appliance according to claim 8, wherein the partition walls (10) have weakening grooves (11) therein.

10. An appliance according to claim 7 wherein, with respect to the base portions, the hinge portion is offset toward the housing (12) when the base portions are in the locked position with the engagement means (3, 13) in mutual engagement.

11. An appliance according to claim 7, wherein the wings are provided with complementary means for mutual positioning of the wings, said complementary means being in releasable mutual engagement when the base portions are in their locking position and the wings are in their service positions.

12. An appliance according to claim 7 and comprising two control members in the form of two push-buttons (18, 19), wherein the base portions have mutually offset faces facing towards the push buttons when the base portions are in the locking position with the engagement means (3, 13) being in mutual engagement; engaging the complementary means (13) of the appliance.

* * * * *